US010692466B2

(12) United States Patent
Lim et al.

(10) Patent No.: US 10,692,466 B2
(45) Date of Patent: Jun. 23, 2020

(54) DISPLAY APPARATUS AND CONTROL METHOD THEREOF

(71) Applicant: SAMSUNG ELECTRONICS CO., LTD., Suwon-si (KR)

(72) Inventors: Jae-moon Lim, Suwon-si (KR); Young-su Moon, Seoul (KR); Young-hoon Jeong, Suwon-si (KR); Chun Zhao, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 43 days.

(21) Appl. No.: 16/026,730

(22) Filed: Jul. 3, 2018

(65) Prior Publication Data

US 2019/0035357 A1 Jan. 31, 2019

(30) Foreign Application Priority Data

Jul. 27, 2017 (KR) ..... 10-2017-0095629

(51) Int. Cl.
*G09G 5/02* (2006.01)
*G09G 3/3208* (2016.01)

(52) U.S. Cl.
CPC ..... *G09G 5/02* (2013.01); *G09G 3/3208* (2013.01); *G09G 2320/0271* (2013.01);
(Continued)

(58) Field of Classification Search
None
See application file for complete search history.

(56) References Cited

U.S. PATENT DOCUMENTS 6,603,104 B1 8/2003 Lee
8,107,123 B2 1/2012 Ono et al.
(Continued)

FOREIGN PATENT DOCUMENTS

JP 2004-020921 A 1/2004
JP 5606467 B2 10/2014
(Continued)

OTHER PUBLICATIONS

Communication dated Oct. 12, 2018, issued by the European Patent Office in counterpart European Application No. 18180364.4.
(Continued)

*Primary Examiner* — Kyle Zhai
(74) *Attorney, Agent, or Firm* — Sughrue Mion, PLLC

(57) ABSTRACT

A display apparatus is provided. The display apparatus includes: a display; a storage configured to store output luminance information of a plurality of grayscale values according to brightness information; and a processor configured to: obtain a plurality of grayscale adjustment curves based on the output luminance information stored in the storage, obtain a plurality of calibration effects by applying each of the plurality of grayscale adjustment curves to an input image, obtain a grayscale adjustment curve corresponding to a maximum calibration effect from among the plurality of calibration effects, adjust a grayscale of each pixel of the input image based on the obtained grayscale adjustment curve to generate an output image, and output the output image through the display.

19 Claims, 9 Drawing Sheets

(52) U.S. Cl.
CPC ..... *G09G 2320/0673* (2013.01); *G09G 2330/021* (2013.01); *G09G 2360/16* (2013.01)

(56) References Cited

U.S. PATENT DOCUMENTS

| | | | | |
|---|---|---|---|---|
| 2006/0209005 | A1 | 9/2006 | Pedram et al. | |
| 2007/0229863 | A1 | 10/2007 | Ono et al. | |
| 2011/0025728 | A1 | 2/2011 | Baba et al. | |
| 2011/0298843 | A1 | 12/2011 | Hajjar et al. | |
| 2013/0135272 | A1 | 5/2013 | Park | |
| 2013/0342585 | A1* | 12/2013 | Chun ..... | G09G 3/3208 345/690 |
| 2014/0176625 | A1 | 6/2014 | Yoon et al. | |
| 2015/0332444 | A1 | 11/2015 | Tsuda et al. | |
| 2016/0019849 | A1 | 1/2016 | Chang et al. | |

FOREIGN PATENT DOCUMENTS

| | | | |
|---|---|---|---|
| KR | 10-0601621 | B1 | 7/2006 |
| KR | 10-0843817 | B1 | 7/2008 |
| KR | 10-1164535 | B1 | 7/2012 |
| KR | 10-2013-0060110 | A | 6/2013 |
| KR | 10-2014-0082002 | A | 7/2014 |
| KR | 10-2016-0046983 | A | 5/2016 |
| WO | 99/41732 | A2 | 8/1999 |

OTHER PUBLICATIONS

Search Report (PCT/ISA/210) dated Oct. 16, 2018, issued by the International Searching Authority in International Application No. PCT/KR2018/007208.

Written Opinion (PCT/ISA/237) dated Oct. 16, 2018, issued by the International Searching Authority in International Application No. PCT/KR2018/007208.

* cited by examiner

FIG. 4

| APL(%) / Grayscale | 0 | 10 | 20 | 30 | ··· | 90 | 100 |
|---|---|---|---|---|---|---|---|
| 0 | 0 | 0 | 0 | 0 | ··· | 0 | 0 |
| 1 | 1 | 1 | 1 | 1 | ··· | 1 | 1 |
| ⋮ | ⋮ | ⋮ | ⋮ | ⋮ | ⋱ | ⋮ | ⋮ |
| 254 | 900 | 900 | 900 | 900 | ··· | 200 | 140 |
| 255 | 1000 | 1000 | 1000 | 1000 | ··· | 250 | 160 |

DISPLAY APPARATUS AND CONTROL METHOD THEREOF

CROSS-REFERENCE TO RELATED APPLICATION

This application is based on and claims priority under 35 U.S.C. § 119 to Korean Patent Application No. 10-2017-0095629, filed on Jul. 27, 2017, in the Korean Intellectual Property Office, the disclosure of which is incorporated by reference herein in its entirety.

BACKGROUND

Field

The disclosure relates to a display apparatus and a control method, and more particularly, to a display apparatus which adjusts luminance, and a control method thereof.

Description of Related Art

With the development of electronic technology, various kinds of electronic devices have been developed and distributed. In particular, display apparatuses are frequently implemented in various devices, such as mobile devices, televisions (TVs), or the like.

The display apparatus may adjust luminance of an original image in order to maintain power consumption within a predetermined range and to prevent a life of a display panel from being shortened. Accordingly, even if an image having different luminance is inputted, the display apparatus consumes power within a predetermined range.

However, merely reducing luminance of an image and outputting the image, may result in a degraded output image resulting from luminance adjustment in comparison to the original image. Accordingly, there is a problem that a user may not properly be provided with an image characteristic such as a dynamic range of the original image.

SUMMARY

One or more embodiments may overcome the above disadvantages and other disadvantages not described above. However, it is understood that one or more embodiment are not required to overcome the disadvantages described above, and may not overcome any of the problems described above.

One or more embodiments provide a display apparatus which minimizes a difference in user's visual sensation between an input image and a corresponding output image, by predicting a change in a dynamic range and adjusting output luminance, and a control method thereof.

In accordance with an aspect of the disclosure, there is provided a display apparatus including a display; a storage configured to store output luminance information of a plurality of grayscale values according to brightness information; and a processor configured to: obtain a plurality of grayscale adjustment curves based on the output luminance information stored in the storage, obtain a plurality of calibration effects by applying each of the plurality of grayscale adjustment curves to an input image, obtain a grayscale adjustment curve corresponding to a maximum calibration effect from among the plurality of calibration effects, adjust a grayscale of each pixel of the input image based on the obtained grayscale adjustment curve to generate an output image, and output the output image through the display. The plurality of calibration effects are based on a change in a dynamic range and a difference in perceived visual sensation.

The processor may be further configured to: obtain a first adjustment image by applying a first grayscale adjustment curve from among the plurality of grayscale adjustment curves to the input image, obtain a second adjustment image by applying a second grayscale adjustment curve from among the plurality of grayscale adjustment curves to the input image, obtain a first dynamic range according to a first predicted output luminance corresponding to brightness information of the first adjustment image, obtain a second dynamic range according to a second predicted output luminance corresponding to brightness information of the second adjustment image, obtain a first dynamic range change by comparing the first dynamic range and an input dynamic range of the input image, and obtain a second dynamic range change by comparing the second dynamic range ranges and the input dynamic range of the input image.

The processor may be further configured to: calculate a first visual sensation difference based on the input image and the first grayscale adjustment curve, calculate a second visual sensation difference based on the input image and the second grayscale adjustment curve, obtain a first calibration effect based on the first visual sensation difference and the first dynamic range change, obtain a second calibration effect based on the second visual sensation difference and the second dynamic range change, and identify one from among the first calibration effect and the second calibration effect as the maximum calibration effect.

The processor may be further configured to: obtain the first calibration effect by applying a first weight to the first dynamic range change and a second weight to the first visual sensation difference, and obtain the second calibration effect by applying the first weight to the second dynamic range change and the second weight to the second visual sensation difference.

The output luminance information of the plurality of grayscale values according to the brightness information of the input image may indicate maximum output luminance information of each pixel according to the brightness information of the input image, and is calculated based on power consumption of the display apparatus.

The plurality of grayscale adjustment curves may include a first tone mapping curve and a second tone mapping curve.

The first tone mapping curve and the second tone mapping curve may be expressed by a following equation, and have different ω values:

$$t_i = 255 \times \left(\frac{i}{255}\right)^{(1+\omega)}.$$

where i indicates a grayscale of a pixel included in the input image, ω is an adjustment value, and $t_i$ is a grayscale of an adjustment image.

The brightness information may indicate an average picture level (APL) of grayscale values of each pixel of the input image.

The processor may be further configured to output the output image through the display according to the adjusted grayscale of each pixel.

In accordance with another aspect of the disclosure, there is provided a control method of controlling a display apparatus, the control method including: obtaining a plurality of grayscale adjustment curves based on output luminance information stored in a storage of the display apparatus; obtaining a plurality of calibration effects by applying each of the plurality of grayscale adjustment curves to an input image; obtaining a grayscale adjustment curve corresponding to a maximum calibration effect from among the plurality of calibration effects; adjusting a grayscale of each pixel of the input image based on the obtained grayscale adjustment curve to generate an output image; and outputting the output image. The plurality of calibration effects are based on a change in a dynamic range and a difference in perceived visual sensation.

The obtaining the plurality of calibration effects may include: obtaining a first adjustment image by applying a first grayscale adjustment curve from among the plurality of grayscale adjustment curves to the input image; obtaining a second adjustment image by applying a second grayscale adjustment curve from among the plurality of grayscale adjustment curves to the input image; obtaining a first dynamic range according to a first predicted output luminance corresponding to brightness information of the first adjustment image; obtaining a second dynamic range according to a second predicted output luminance corresponding to brightness information of the second adjustment image; obtaining a first dynamic range change by comparing the first dynamic range and an input dynamic range of the input image; and obtaining a second dynamic range change by comparing the second dynamic range and the input dynamic range of the input image.

The obtaining the plurality of calibration effects may include: calculating a first visual sensation difference based on the input image and the first grayscale adjustment curve; calculating a second visual sensation difference based on the input image and the second grayscale adjustment curve; obtaining a first calibration effect based on the first visual sensation difference and the first dynamic range change; and obtaining a second calibration effect based on the second visual sensation difference and the second dynamic range change. The obtaining the grayscale adjustment curve corresponding to the maximum calibration effect may further include identifying one from among the first calibration effect and the second calibration effect as the maximum calibration effect.

The obtaining the plurality of calibration effects may further include: obtaining the first calibration effect by applying a first weight to the first dynamic range change and a second weight to the first visual sensation difference; and obtaining the second calibration effect by applying the first weight to the second dynamic range change and the second weight to the second visual sensation difference.

The output luminance information may indicate maximum output luminance information of each pixel according to the brightness information of the input image, and may be calculated based on power consumption of the display apparatus.

The plurality of grayscale adjustment curves may include a first tone mapping curve and a second tone mapping curve.

The first tone mapping curve and the second tone mapping curve may be expressed by a following equation, and have different ω values:

$$t_i = 255 \times \left(\frac{i}{255}\right)^{(1+\omega)}.$$

where i indicates a grayscale of a pixel included in the input image, ω is an adjustment value, and $t_i$ is a grayscale of an adjustment image.

The brightness information may indicate an average picture level (APL) of grayscale values of each pixel of the input image.

The outputting may include outputting the output image according to the adjusted grayscale of each pixel.

In accordance with yet another aspect of the disclosure, there is provided a non-transitory computer-readable medium which stores computer instructions to control a display apparatus to perform an operation when executed by a processor of the display apparatus, the operation including: obtaining a plurality of grayscale adjustment curves based on output luminance information; obtaining a plurality of calibration effects by applying the plurality of grayscale adjustment curves to an input image; obtaining a grayscale adjustment curve corresponding to a maximum calibration effect from among the plurality of calibration effects; adjusting a grayscale of each pixel of the input image based on the obtained grayscale adjustment curve to generate an output image; and controlling a display of the display apparatus to output the output image. The plurality of calibration effects are based on a change in a dynamic range and a difference in perceived visual sensation.

In accordance with still yet another aspect of the disclosure, there is provided a display apparatus including: a display; and a processor configured to: obtain a first calibration effect by applying a first grayscale adjustment curve to an input image, obtain a second calibration effect by applying a second grayscale adjustment curve to the input image; determine a selected grayscale adjustment curve from among the first grayscale adjustment curve and the second grayscale adjustment curve based on the first calibration effect and the second calibration effect, adjust a grayscale of each pixel of the input image based on the selected grayscale adjustment curve to generate an output image, and control the display to output the output image.

The processor may be further configured to determine, in a determination, whether a difference between the input image and the input image as modified based on the selected grayscale adjustment curve exceeds a threshold, and select one from among the input image and the input image as modified based on the selected grayscale adjustment curve as the output image based on the determination.

Additional and/or other aspects and advantages will be set forth in part in the description which follows and, in part, will be obvious from the description, or may be learned by practice of embodiments.

BRIEF DESCRIPTION OF THE DRAWINGS

The above and/or other aspects of the present disclosure will be more apparent by describing certain embodiments of the present disclosure with reference to the accompanying drawings, in which:

FIG. 4 is a table illustrating output luminance information of each grayscale according to an embodiment;

DETAILED DESCRIPTION

Figure 1:
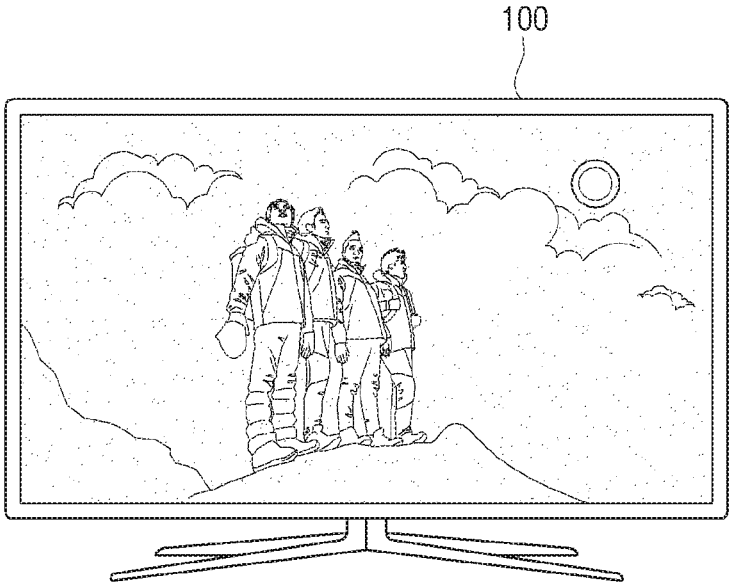
FIG. 1 is a view to illustrate a display apparatus which adjusts luminance according to an embodiment.

Hereinafter, the present disclosure will be described in detail with reference to the accompanying drawings. In the following description, detailed descriptions of well-known functions or configurations may be omitted. In addition, embodiments described below may be changed in various forms, and the scope of the technical idea of the present disclosure is not limited to the embodiments described below. Rather, the embodiments are provided so that this disclosure will be thorough and complete, and will fully convey the scope of the application to those of ordinary skill in the art.

As used herein, the terms "1st" or "first" and "2nd" or "second" may use corresponding components regardless of importance or order and are used to distinguish a component from another component without limiting the components. Expressions such as "at least one of" when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c. In addition, when a certain portion "includes" a certain element, it means that the portion may further include other elements rather than excluding other elements unless the context clearly indicates otherwise. Furthermore, various elements and regions in the drawings are schematically illustrated. Accordingly, the technical idea of the present disclosure is not limited to relative sizes or gaps illustrated in the drawings attached hereto.

FIG. 1 is a view to illustrate a display apparatus 100 which adjusts luminance according to an embodiment.

As shown in FIG. 1, the display apparatus 100 may be implemented as a TV, but embodiments are not limited thereto, and any device provided with a display function, such as a smart phone, a tablet PC, a portable multimedia player (PMP), a personal digital assistant (PDA), a notebook PC, a smart watch, a head mounted display (HMD), a near eye display (NED), or the like, is applicable without any limitation.

The display apparatus 100 may provided with a display implemented in various forms, such as a liquid crystal display (LCD), an organic light emitting diode (OLED), a liquid crystal on silicon (LCoS), digital light processing (DLP), a quantum dot (QD) display panel, or the like, in order to provide a display function.

In particular, the display apparatus 100 may be provided with a display formed of a self-emitting element such as an OLED. In this case, the life of the self-emitting element is shortened due to high power consumption.

Accordingly, when an image requiring high power consumption, such as a bright image, is inputted, the display apparatus 100 according to an embodiment may maintain power consumption of the display 110 at a predetermined level or lower by reducing output luminance of the display.

However, when the output luminance of the display is reduced to maintain the power consumption, a dynamic range may also be reduced. Dynamic range indicates how many signals can be represented in a displayed image. For example, when the output luminance of the image is reduced by considering only the power consumption, the dynamic range may be significantly narrowed, and there may be a great difference in a perceived, or user, visual sensation regarding an output image in comparison to an input image.

The display apparatus 100 according to an embodiment may maintain both the dynamic range and the reduced power consumption by adjusting a grayscale of an input image.

Specifically, the display apparatus 100 may reduce a difference in perceived visual sensation regarding an output image in comparison to an input image, that is, a distortion of the input image, by adjusting the grayscale of the input image, while maintaining the dynamic range at a predetermined level, and may output the output image. Hereinafter, various embodiments will be described with reference to the drawings.

Figure 2A:
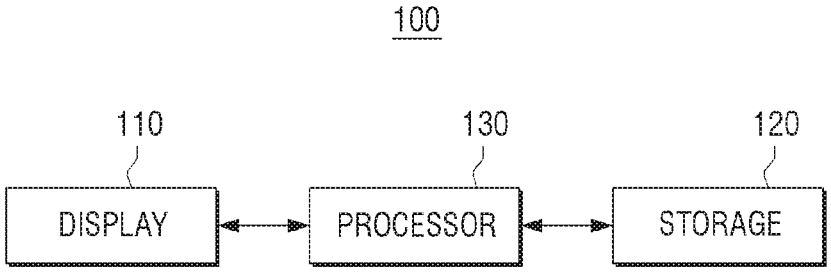
FIG. 2A is a block diagram illustrating a configuration of a display apparatus according to an embodiment.

FIG. 2A is a block diagram illustrating a configuration of a display apparatus according to an embodiment.

Referring to FIG. 2A, the display apparatus 100 includes a display 110, a storage 120, and a processor 130.

The display 110 may provide various content screens which can be provided through the display apparatus 100. Herein, the content screen may include various contents, such as an image, a video, a text, music, etc., application execution screens including various contents, a graphic user interface (GUI) screen, or the like.

The display 110 may be implemented as displays of various forms such as an LCD, an OLED, an LCoS, a DLP, or the like as described above. In addition, the display 110 may be implemented as a transparent display implemented by using a transparent material and displaying information.

In particular, the display 110 according to an embodiment may be implemented as a self-emitting display such as an OLED.

The display 110 may be implemented in the form of a touch screen including an interlayer structure with a touch pad. In this case, the display 110 may be used as an input interface as well as an output apparatus.

The storage 120 may store an operating system (O/S) software module for driving the display apparatus 100, and various data such as various multimedia contents.

In particular, the storage 120 may store output luminance information of each grayscale. Herein, grayscale is an integer representation of brightness of each pixel included in an image. For example, an image of 8 bits may be expressed by a grayscale ranging from 0 to 255 levels. An integer corresponding to brightness of each pixel may be expressed as a grayscale value, a brightness value, a brightness code, or the like, and in the following description, the integer will be referred to as a grayscale value. In addition, brightness information of an image may be an average picture level (hereinafter, "APL") of each frame of the image. For example, brightness information of an image may be an average grayscale value regarding pixel data of one frame unit of an input image. In this case, as the APL increases, a relatively bright image may be outputted, and, as the APL decreases, a relatively dark image may be outputted. However, the brightness of an image may mean various characteristics of the image related to power consumption of the display apparatus 100, such as a maximum grayscale value, a most frequent grayscale value, or the like, in addition the APL.

According to an embodiment, the output luminance information of each grayscale may be information for adjusting output luminance of each grayscale of an input image that is set by considering power consumption of the display apparatus 100. For example, the output luminance information of each grayscale may include maximum output luminance information for each grayscale according to brightness information of an input image that is calculated based on power consumption of the display apparatus 100. Specifically, the corresponding information may be information that is set by considering average power consumption of the display apparatus 100. Herein, the average power consumption may be power consumption per unit time of a predetermined section (for example, a frame unit) of an image when the predetermined section of the image is outputted. The storage 120 may store information for adjusting output luminance of each grayscale (that is, brightness code) to maintain power consumption within a predetermined section regardless of brightness of an image when the image is outputted. For example, the storage 120 may store information regarding maximum output luminance of each grayscale for allowing power consumption of the display apparatus 100 to remain within a predetermined range in outputting an input image, or information regarding maximum output luminance of each grayscale according to brightness information of an input image to constantly maintain power consumption. For example, a grayscale value of 254 level may be adjusted to output luminance between 140 Nits and 900 Nits to maintain brightness of an image and power consumption of the display apparatus 100 to within a predetermined range, and may be outputted. Various embodiments regarding the information for adjusting output luminance of each grayscale, stored in the storage 120, and information regarding a change in the output luminance will be described in detail below with reference to FIGS. 4 and 5.

The processor 130 controls an overall operation of the display apparatus 100. The processor 130 may include one or more of a digital signal processor (DSP), a central processing unit (CPU), a controller, an application processor (AP), a communication processor (CP), and an ARM processor, or may be defined by a corresponding term.

The processor 130 may obtain brightness information of an input image. Herein, the brightness information of the input image may be an APL of each frame of the input image as described above. That is, the processor 130 may obtain an average grayscale value of a plurality of pixels included in an image. However, the brightness information of the input image may be any information that indicates characteristics of the image influencing power consumption of the display apparatus 100 when the image is outputted. For example, the processor 130 may obtain the brightness information of the input image according to various criteria, such as a maximum grayscale value among a plurality of grayscale values of the input image, a maximum grayscale value of each of red (R), green (G), and blue (B), a most frequent grayscale value, a most frequent grayscale value of each of R, G, B, maximum brightness information of the image, or the like. Various embodiments for obtaining the brightness information of the input image will be described in detail below with reference to FIG. 4.

According to an embodiment, the processor 130 may obtain a plurality of grayscale adjustment curves for expanding a dynamic range of the input image, based on the brightness information of the input image and information stored in the storage 120. Herein, the grayscale adjustment curve may be a curve for adjusting an input grayscale value to a different grayscale, and the grayscale adjustment curve may be applied to each pixel included in an input image. For example, a tone mapping (TM) curve may be used as the grayscale adjustment curve. However, this should not be considered as limiting, and all mathematical equations or graphs for adjusting a grayscale of a pixel in an image to a different grayscale may be used as the grayscale adjustment curve.

When the input image is outputted and the brightness of the input image is not adjusted by a grayscale adjustment curve, the output luminance of each grayscale included in the input image may be reduced to constantly maintain power consumption. In this case, the width of the dynamic range of the output image may be narrowed, and an image in which a characteristic of the image, that is, a difference between a dark portion and a bright portion in the image, is degraded in comparison to an input original image may be provided.

According to an embodiment, the processor 130 may obtain a plurality of calibration effects based on the grayscale adjustment curve for adjusting the grayscale of each pixel included in the input image, while expanding the dynamic range, and may adjust the grayscale of each pixel based on a grayscale adjustment curve corresponding to a maximum calibration effect among the plurality of calibration effects, and may output the image. In this case, the brightness of the output image may be relatively darker than the brightness of the input image, that is, of the original image, but the dynamic range of the output image may increase in comparison to the dynamic range when the image is outputted, while maintaining the brightness of the input image.

According to an embodiment, the plurality of calibration effects may be calculated based on a change in the dynamic range, caused by applying each of the plurality of grayscale adjustment curves to the input image, respectively, and a difference in perceived visual sensation. Herein, the difference in perceived visual sensation may indicate all degraded characteristics of the image having brightness adjusted in comparison to the input original image, as the grayscale of each pixel of the input image is adjusted based on the grayscale adjustment curve. For example, when the brightness of the input image is adjusted, the processor 130 may obtain a difference in perceived visual sensation based on a change in the brightness, contrast, gamma value, a grayscale value, or the like of the image.

According to an embodiment, the processor 130 may obtain a first adjustment image and a second adjustment image by applying a first grayscale adjustment curve and a second grayscale adjustment curve of the plurality of grayscale adjustment curves to the input image, respectively. In this case, the first adjustment image and the second adjustment image may be relatively dark in comparison to the input image, as the grayscales thereof are adjusted.

The processor 130 may predict output luminance according to brightness information of each of the first adjustment image and the second adjustment image. Specifically, the processor 130 may obtain a first dynamic range by predicting the output luminance when the first adjustment image is outputted, based on brightness information of the first adjustment image and output luminance information of each grayscale according to the brightness information. In addition, the processor 130 may obtain a second dynamic range by predicting the output luminance when the second adjustment image is outputted, based on brightness information of the second adjustment image and output luminance information of each grayscale according to the brightness information. The processor 130 may obtain changes in the first and second dynamic ranges in comparison to the input image, by comparing the obtained first and second dynamic ranges and the dynamic range of the input image.

In addition, according to an embodiment, the processor 130 may calculate differences in perceived visual sensations regarding the first and second adjustment images in comparison to the input image. That is, the processor 130 may calculate a difference of a first visual sensation on the first adjustment image and a difference of a second visual sensation on the second adjustment image. For example, the processor 130 may calculate the difference of the first visual sensation based on a difference value between a graph for maintaining the grayscale of each pixel included in the input image and the first grayscale adjustment curve, and may calculate the difference of the second visual sensation based on a difference value between a graph for maintaining the grayscale and the second grayscale adjustment curve. A specific embodiment for calculating the difference in the visual sensation based on the difference value between the graph and the grayscale adjustment curve will be described below with reference to FIG. 5. According to an embodiment, the processor 130 may obtain a first calibration effect based on the change in the first dynamic range and the difference of the first visual sensation, and may obtain a second calibration effect based on the change in the second dynamic range and the difference of the second visual sensation. For example, the processor 130 may calculate the plurality of calibration effects by applying a first weight to the changes in the first and second dynamic ranges, and applying a second weight to the differences of the first and second visual sensations. That is, the processor 130 may calculate a calibration effect based on Equation 1 presented below:

$$E=\alpha_{sin}\omega_{sin}+\alpha_{DR}\omega_{DR} \quad \text{Equation 1:}$$

In Equation 1, E is a calibration effect of an adjustment image, $\omega_{sin}$ is a difference of a perceived visual sensation, $\omega_{DR}$ is a change in a dynamic range, and $\alpha_{sin}$ and $\alpha_{DR}$ are weights, that is, constant values. Constant values $\alpha_{sin}$ and $\alpha_{DR}$ correspond to a manufacturer setting of the display apparatus 100, and may be determined according to manufacturer's preference to relatively highlight one of the difference of perceived visual sensation and the change in the dynamic range in comparison to the other one, in adjusting the brightness of an input image. However, this should not be considered as limiting, and $\alpha_{sin}$ and $\alpha_{DR}$ may be the same constant value or may be changed according to user's setting. $\omega_{sin}$ indicates a difference of perceived visual sensation regarding an image the brightness of which is adjusted according to adjustment of the grayscale in comparison to the input image. Therefore, as $\omega_{sin}$ decreases, similarity between the input image and the adjusted image increases. In addition, $\omega_{DR}$ indicates a change in the dynamic range, and, as the dynamic range increases, $\omega_{DR}$ is reduced. That is, the dynamic range and $\omega_{DR}$ are inversely proportional to each other. To the contrary, an increase in $\omega_{DR}$ indicates that the dynamic range of the adjusted image may be narrowed in comparison to the dynamic range of the input original image.

According to an embodiment, the processor 130 may obtain a plurality of grayscale adjustment images and may obtain calibration effects regarding the plurality of grayscale adjustment images. For example, the processor 130 may obtain a change in the dynamic range and a difference in perceived visual sensation based on the plurality of grayscale adjustment images obtained by applying the plurality of grayscale adjustment curves, and may calculate the plurality of calibration effects based on Equation 1 described above.

The display apparatus 100 may identify a maximum calibration effect among the plurality of calibration effects. Specifically, according to Equation 1 described above, $\omega_{DR}$ is reduced as the dynamic range increases and $\omega_{sin}$ is reduced as the difference of perceived visual sensation decreases. Therefore, a grayscale adjustment image having the calibration effect, that is, E, corresponding to the smallest value, may be outputted. For example, when both the first adjustment image and the second adjustment image have increased dynamic ranges in comparison to the input image, the display apparatus 100 may identify one of the first and second calibration effects as a maximum calibration effect, by additionally considering the difference of perceived visual sensation. For example, when $\alpha_{sin}$ is set to a relatively larger value than $\alpha_{DR}$ according to any one of the manufacturer' preference and the perceived setting in Equation 1 described above, it means that a relatively higher weight is given to the difference of perceived visual sensation than to the change in the dynamic range. In this case, the processor 130 may identify, as the maximum calibration effect, one of the first calibration effect and the second calibration effect that has the increased dynamic range and has a relatively small difference in perceived visual sensation in comparison to the input image.

The processor 130 may adjust the grayscale of each pixel of the input image based on a grayscale adjustment curve corresponding to the maximum calibration effect. In addition, the processor 130 may output the input image with output luminance corresponding to the adjusted grayscale or output luminance corresponding to the adjusted image. Accordingly, power consumption can be constantly maintained, and an image in which the dynamic range increases and the difference of perceived visual sensation is optimized according to the manufacturer's preference or perceived setting can be outputted. In this case, because the grayscale adjustment image has the grayscale value of each pixel adjusted in comparison to the input original image, the display apparatus 100 may output the image with the output luminance corresponding to the adjusted grayscale. Various embodiments for obtaining the plurality of grayscale adjustment curves and obtaining the plurality of adjustment images by applying the plurality of adjustment grayscale curves to the input image will be described in detail below with reference to FIG. 4.

Figure 2B:
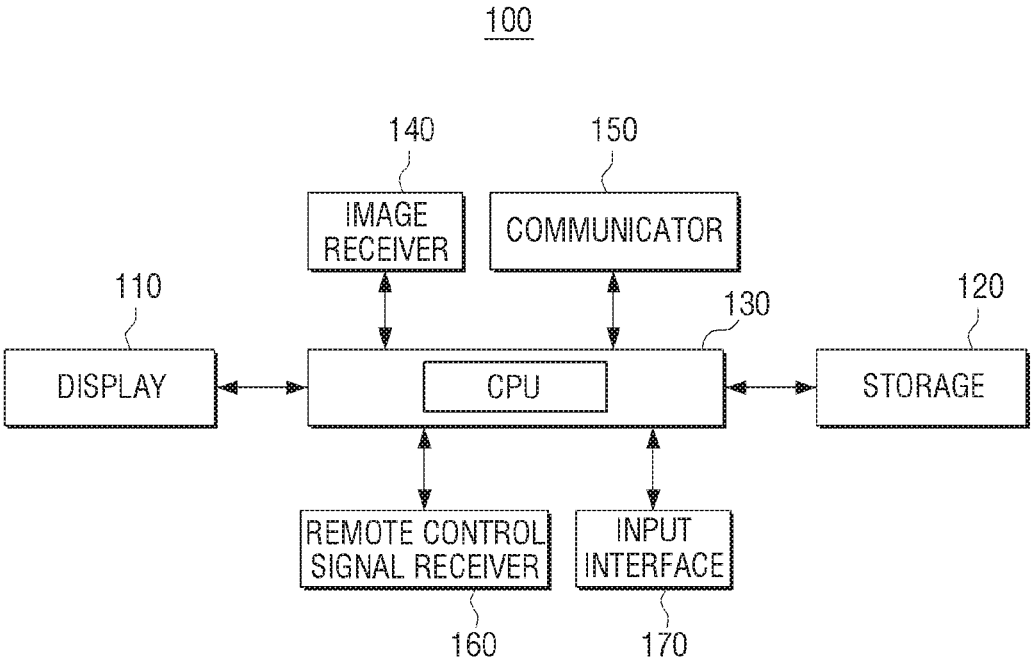
FIG. 2B is a block diagram illustrating a detailed configuration of the display apparatus of FIG. 2A.

FIG. 2B is a block diagram illustrating a detailed configuration of the display apparatus illustrated in FIG. 2A.

Referring to FIG. 2B, the display apparatus 100 includes a display 110, a storage 120, a processor 130, an image receiver 140, a communicator 150, a remote control signal receiver 160, and an input interface 170. The same elements in the configuration of FIG. 2B as those illustrated in FIG. 2A will not be described in detail.

The processor 130 may obtain a plurality of grayscale adjustment curves for expanding a dynamic range of an input image, based on brightness information of the input image and information stored in the storage 120. In addition, the processor 130 may obtain a plurality of adjustment images, that is, a plurality of grayscale-adjusted images, by applying each of the plurality of grayscale adjustment curves to the input image. In addition, the processor 130 may calculate calibration effects corresponding to the plurality of adjustment images, and may output an adjustment image by applying a grayscale adjustment curve corresponding to a maximum calibration effect of the plurality of calibration effects to the input image. In this case, the outputted adjustment image may have a dynamic range increased in comparison to the dynamic range when the input image is outputted as it is, and the user may be provided with an output image in which the dynamic range of the input image is preserved at a predetermined level.

According to an embodiment, the processor 130 may include a CPU, a read only memory (ROM) (or a nonvolatile memory) which stores a control program for controlling the display apparatus 100, and a random access memory (RAM) (or a volatile memory) which stores data inputted from the outside of the display apparatus 100 or is used as a storage region corresponding to various tasks performed in the display apparatus 100.

The CPU may access the storage 120 and perform booting by using the O/S stored in the storage 120. In addition, the CPU may perform various operations by using various programs, contents, data, or the like stored in the storage 120. The various programs and O/S stored in the storage 120 may contain code made by a compiler or a code executable by an interpreter.

Herein, the storage 120 may be implemented as an internal memory such as a ROM, a RAM, or the like included in the processor 130, or may be implemented as a separate memory from the processor 130. In this case, the storage 120 may be implemented in the formed of a memory embedded in the display apparatus 100 or may be implemented in the form of a memory attachable to or detachable from the display apparatus 100. For example, data for driving the display apparatus 100 may be stored in the memory embedded in the display apparatus 100, and data for an expanding function of the display apparatus 100 may be stored in the memory attachable to or detachable from the display apparatus 100. The memory embedded in the display apparatus 100 may be implemented in the form of a nonvolatile memory, a volatile memory, a hard disk drive (HDD), or a solid state drive (SSD), and the memory attachable to or detachable from the display apparatus 100 may be implemented in the form of a memory card (for example, a micro SD card, a USB memory, or the like), or an external memory (for example, a USB memory) connectable with a USB port.

The image receiver 140 may be implemented as a tuner to receive a broadcasting image, but embodiments are not limited thereto. The image receiver 140 may be implemented as various types of communication modules to receive various external images, such as a WiFi module, a USB module, an HDMI module, or the like. In addition, an image may be stored in the storage 120. In this case, the display apparatus 100 may adjust a grayscale of each pixel and output luminance of the image stored in the storage 120 according to various embodiments, and may output the image.

The communicator 150 may be a transceiver (transmitter and receiver) configured to transmit/receive an image. For example, the communicator 150 may receive a sound signal in a streaming method or a download method from an external device (for example, a source device), an external storage medium (for example, a USB), an external server (for example, a web head), or the like through a communication method such as AP-based WiFi (wireless LAN network), Bluetooth, Zigbee, wired/wireless local area network (LAN), WAN, Ethernet, IEEE 1394, HDMI, USB, MHL, AES/EBU, Optical, Coaxial, or the like. In addition, the communicator 150 may receive output luminance information of each grayscale according to brightness information of an image from an external server. For example, the display apparatus 100 may receive information from an external server, may store the information in the storage 120, and may update pre-stored information based on information received from an external server.

le;.4qThe remote control signal receiver 160 is configured to receive a remote control signal transmitted from a remote controller. The remote control signal receiver 160 may be implemented in the form of including a light receiving interface to receive an infrared (IR) signal, or may be implemented in the form of receiving a remote control signal by communicating with the remote controller according to a wireless communication protocol such as Bluetooth or WiFi.

The input interface 170 may be implemented as various buttons provided on a main body of the display apparatus 100. The user may input, through the input interface 170, various user commands such as a turn on/off command, a channel change command, a volume control command, a menu confirmation command, or the like.

According to an embodiment, the display apparatus 100 may control adjustment of a grayscale and output luminance of an input image based on a user input on the remote control signal receiver 160 or the input interface 170. For example, the display apparatus 100 may have a plurality of modes. The modes may include a maximum output mode for increasing power consumption of the display apparatus 100 in outputting an image, a standard mode, a power saving mode for reducing power consumption of the display apparatus 100 in outputting an image, or the like. The display apparatus 100 may identify a maximum calibration effect among a plurality of calibration effects based on a current mode set, and may obtain a grayscale adjustment curve corresponding to the maximum calibration effect. For example, in the maximum output mode, maximum output luminance of each gray scale increases, and based on this, the display apparatus 100 may identify the maximum calibration effect among the plurality of calibration effects calculated based on a dynamic range and a difference in a visual sensation.

Figure 3:
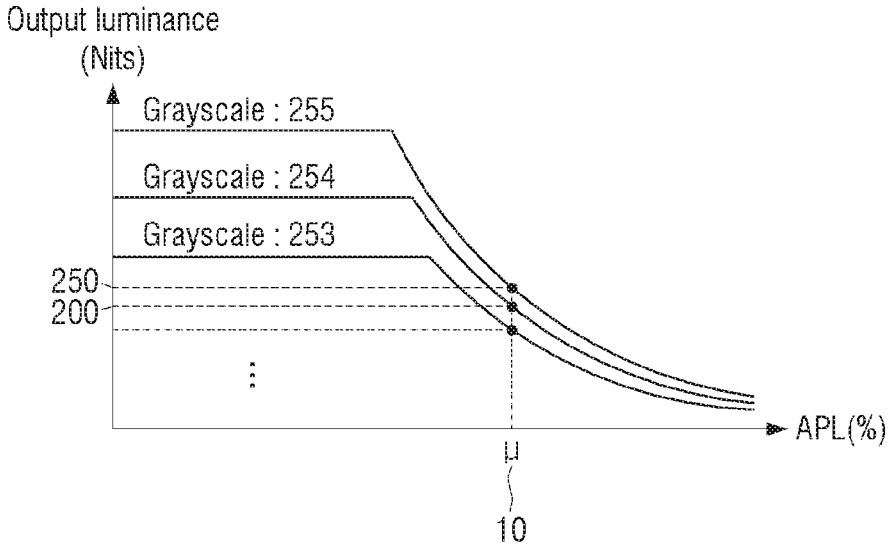
FIG. 3 is a graph to illustrate output luminance information of each grayscale level according to an embodiment.

FIG. 3 is a graph to illustrate output luminance information of each grayscale according to an embodiment.

Referring to FIG. 3, the display apparatus 100 may store information of output luminance of each grayscale according to brightness information of an image. Specifically, in the graph shown in FIG. 3, the X-axis indicates an APL, that is, average brightness of an image, and the Y-axis indicates output luminance (Nits). Each graph indicates output luminance of each grayscale to constantly maintain power consumption. As described above, in the case of an image of 8 bits, the grayscale is represented by an integer ranging from 0 to 255. Therefore, 256 graphs in total, indicating output luminance (Y-axis) according to average brightness (X-axis) of the image for each of grayscales 0 to 255, may be stored. The graph illustrated in FIG. 3 will be referred to as a peak luminance control (PLC) curve.

The X-axis of the PLC curve is not limited to the APL (average brightness of the image) value, and a value according to all characteristics of the image that can digitize brightness of the image, or all characteristic of the image influencing power consumption of the display apparatus 100 in outputting the image may be set to the X-axis. For example, the display apparatus 100 may store a graph in which an average of maximum brightness of each of R, G, B of an image is set to the X-axis.

According to an embodiment, the display apparatus 100 may obtain brightness information of an input image based on Equations 2 and 3 presented below:

$$Y_p=0.299\times R_p+0.587\times G_p+0.114\times B_p \quad \text{Equation 2:}$$

In Equation 2, p(=[x,y]$^T$ (0≤x≤W 0≤y≤H)) is a position of each pixel in the image, and W and H are a width and a height of the image, respectively. In addition, $R_p$, $G_p$, $B_p$, and $Y_p$ are R, G, B, and a brightness code in the image at p.

$$\mu = 100 \times \left( \frac{1}{W \times H} \sum_{p \in I} \frac{Y_p}{255} \right) (\%) \quad \text{Equation 3}$$

In equation 3, μ% is brightness information of an input image. The display apparatus 100 may obtain output luminance of each grayscale based on the graph shown in FIG. 3, that is, the PLC curves. In addition, the display apparatus 100 may obtain a dynamic range from the output luminance of the maximum grayscale of the input image. For example, when the brightness information μ(10) of a current input image is 90%, the grayscale value (or brightness code) 255 of the grayscales included in the input image may be outputted with 250 (Nits), and the grayscale value 254 may be outputted with 200 (Nits). In this case, the dynamic range may be output luminance of the maximum grayscale value, that is, 250 (Nits).

According to an embodiment, the display apparatus 100 may obtain brightness information of the image by using any one of Equations 4 and 5 presented below instead of Equation 2 described above, and by using any one of Equations 6 and 7 presented below instead of Equation 3 described above. However, in obtaining brightness information of the input image, the display apparatus 100 may not necessarily use Equations 2 to 7, and may use all equations that can digitize a change in power consumption of the display apparatus 100 in outputting the input image.

$$Y_p = \max\{R_p, G_p, B_p\} \quad \text{Equation 4}$$

$$Y_p = \frac{(R_p + G_p + B_p)}{3} \quad \text{Equation 5}$$

$$\mu = \sum_{p \in I} Y_p^{2.2} \quad \text{Equation 6}$$

$$\mu = \sum_{p \in I} w_0 + R_p^{2.2} + G_p^{2.2} + B_p^{2.2} \quad \text{Equation 7}$$

FIG. 4 is a table to illustrate output luminance information of each grayscale according to an embodiment.

Referring to FIG. 4, information of output luminance of each grayscale is shown according to brightness of an image. In the graph of FIG. 3 and the table of FIG. 4, numerical values may vary according to a characteristic of the display apparatus 100, for example, a manufacturer, a type, a model, or the like. In addition, each numerical value may be a fixed value that is stored in the display apparatus 100 at a manufacturing step. However, this should not be considered as limiting, and the numeral values may be changed according to user's setting or update (for example, firmware update) based on information received from an external server as described above.

It can be seen from FIG. 3 that, as the brightness of the input image increases, the dynamic range is greatly reduced with reference to a peak point on the graph. When the display apparatus 100 adjusts output luminance only based on the PLC curve, power consumption of the display apparatus 100 may be maintained within a predetermined range when the image is outputted, but the dynamic range of the output image may be reduced to a predetermined level or lower, and there may be a problem that the image is outputted without calibrating the dynamic range. Accordingly, there is a need for compensating for the reduction of the dynamic range of the output image by a predetermined level or higher by adjusting the brightness of the input image or the grayscale value of each pixel.

Hereinafter, various embodiments for obtaining a grayscale adjustment value and adjusting brightness of an image based on the grayscale adjustment value will be described.

Figure 5:
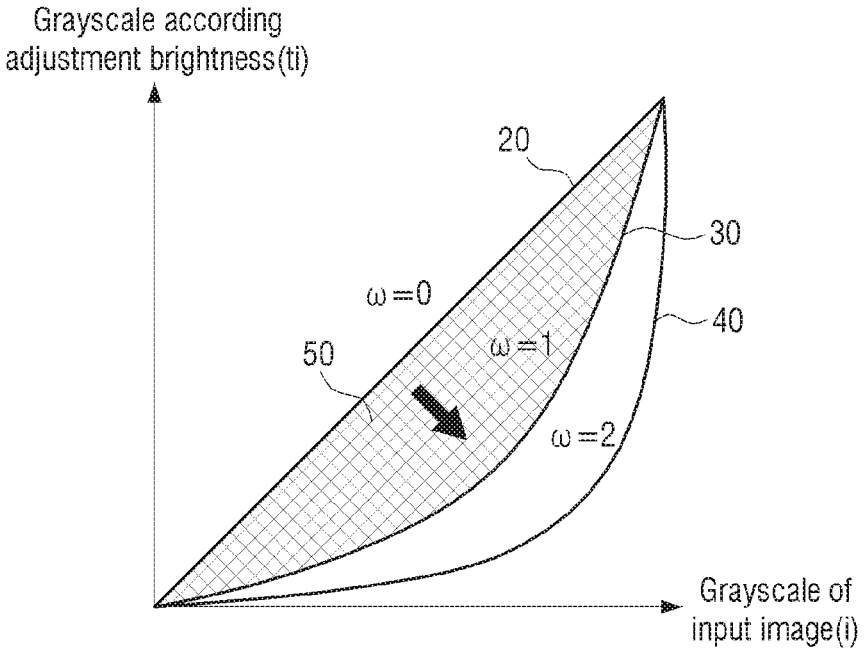
FIG. 5 is a graph to illustrate grayscale adjustment curves according to an embodiment.

FIG. 5 is a graph to illustrate a grayscale adjustment curve according to an embodiment.

Referring to FIG. 5, the display apparatus 100 may map a grayscale of each pixel included in an input image to a different adjustment grayscale, based on the grayscale adjustment curve. For example, the grayscale adjustment curve may be a tone mapping curve based on Equation 8 presented below, and may have a trace as shown in FIG. 5. In the graph, the X-axis indicates a grayscale of an input image, and the Y-axis indicates a grayscale of an adjustment image. However, the grayscale adjustment curve is not limited to Equation 8 presented below, and various types of equations, traces, and graphs for mapping a grayscale onto a different adjustment grayscale may be used.

$$t_i = 255 \times \left( \frac{i}{255} \right)^{(1+\omega)} \quad \text{Equation 8}$$

In Equation 8, i is a grayscale of each pixel included in an input image, ω is an adjustment value, and $t_i$ is a grayscale of an adjustment image.

According to an embodiment, the display apparatus 100 may obtain a plurality of adjustment images by applying each of the plurality of grayscale adjustment curves to the input image. Specifically, as shown in FIG. 5, the display apparatus 100 may obtain the plurality of grayscale adjustment curves corresponding to the plurality of adjustment values (ω). For example, when the adjustment value (ω) is 0 (ω=0, 20), the grayscale may not be adjusted and a grayscale adjustment image may be the same as the input image. That is, the brightness information of the image may not be changed. When the adjustment value is 0, the graph may indicate that the grayscale of each pixel included in the input image is maintained. On the other hand, when the adjustment value is non-zero, the grayscale of the input image may be adjusted. For example, when the adjustment value (ω) is 1 (ω=1, 30), the display apparatus 100 may adjust the grayscale value 150 (that is, i=150) to 88.2 (that is, $t_i$=88.2) based on Equation 8. That is, the display apparatus 100 may adjust a pixel having the grayscale value 150 among the plurality of pixels included in the input image to have the grayscale value 88.2. When the grayscale values (for example, 0-255) of all pixels included in the input image are adjusted based on Equation 8 as described above, the brightness information of the input image may be changed and the display apparatus 100 may obtain an adjustment image.

In addition, according to an embodiment, when the adjustment value (ω) is 2 (ω=2, 40), the grayscale value 150 (that is, i=150) may be adjusted to 51.9 (that is, $t_i$=51.9) based on Equation 8. According to an embodiment, the display apparatus 100 may obtain the plurality of grayscale adjustment images and the changed brightness information based on at least one of the plurality of adjustment values and the plurality of grayscale adjustment curves as described above.

Equation 8 is an example indicating a relationship between the grayscale value and the grayscale adjustment value according to a weight, but embodiments are not limited thereto. For example, the display apparatus 100 may obtain a grayscale adjustment value corresponding to a grayscale value of an image input based on well-known tone mapping (TM) curves of various forms.

Figure 6:
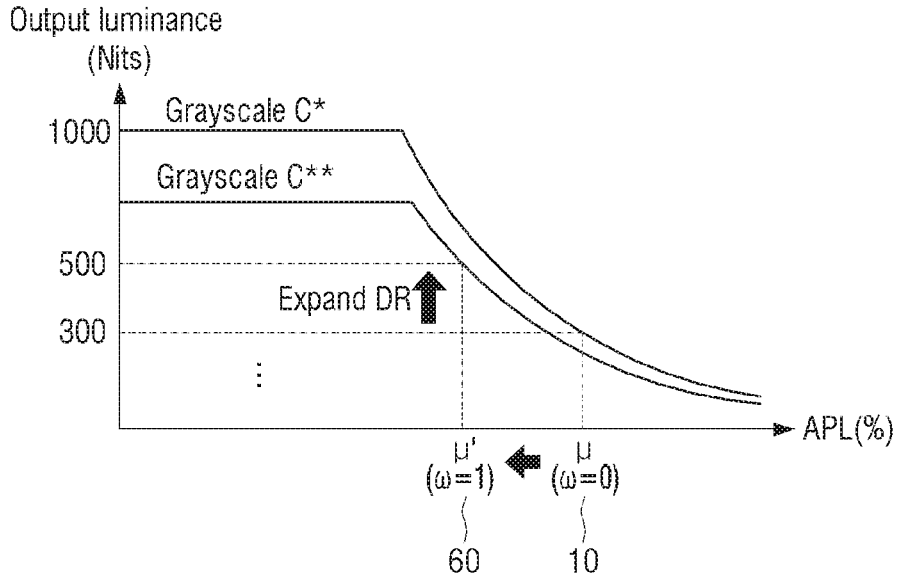
FIG. 6 is a graph to illustrate a change in a dynamic range of a grayscale adjustment image according to an embodiment.

FIG. 6 is a view to illustrate a change in a dynamic range of a grayscale adjustment image according to an embodiment.

Referring to FIG. 6, when brightness information of an input image is changed as the grayscale of the input image is adjusted, output luminance of each grayscale may be adjusted. For example, when brightness information μ 10 of the input image is changed to μ 60, the output luminance may be adjusted according to this change. For example, a grayscale value C* may be adjusted to C**, and accordingly, the output luminance may be adjusted from 300 (Nits) to 500 (Nits). In this case, the dynamic range of the input image may increase from 300 to 500, and a change in the dynamic range is 200.

According to an embodiment, the display apparatus 100 may obtain a plurality of grayscale adjustment images based on a plurality of grayscale adjustment curves according to a plurality of adjustment values (for example, ω=1, ω=2, . . . , ω=n). In this case, the display apparatus 100 may obtain a change in the dynamic range of each of the plurality of grayscale adjustment images. That is, the display apparatus 100 may obtain a plurality of $\omega_{dr}$ according to the change in the dynamic range.

In addition, the display apparatus 100 may obtain a difference in perceived visual sensation, that is, $\omega_{sin}$, by comparing the plurality of grayscale adjustment images and the input original image. For example, the difference between the input original image and the grayscale adjustment image may be obtained based on an area between the graphs shown in FIG. 5. For example, when the adjustment value (ω) is 0 (20), the graph indicates that grayscale of the input original image is not adjusted, that is, the grayscale of each pixel included in the input image, is maintained. When the adjustment (ω) is 1 (30), a first adjustment image having a grayscale adjusted from the input original image may be obtained. In this case, the display apparatus 100 may obtain $\omega_{sin}$ based on an area 50 between the graph when the adjustment value (ω) is 0 and the graph when the adjustment value (ω) is 1.

According to another embodiment, the display apparatus 100 may determine whether the difference in perceived visual sensation between the input image and the grayscale adjustment image falls within a predetermined threshold range. For example, the display apparatus 100 determines whether the above-described area 50 falls within a predetermined threshold, and, when the area 50 exceeds the predetermined threshold, the display apparatus 100 may determine that the grayscale adjustment image (or brightness-adjusted image) is degraded even if the dynamic range increases. In this case, the display apparatus 100 may omit the process of applying a grayscale adjustment curve corresponding to an adjustment value corresponding to the grayscale adjustment image exceeding the threshold to the input image.

The configuration of obtaining $\omega_{sin}$ based on the area 50 is an embodiment of the present disclosure, and the display apparatus 100 may obtain the difference $\omega_{sin}$ in perceived visual sensation based on a change in characteristics of the input image and characteristics (for example, contrast, a contrast ratio, power consumption, a gamma value) of the grayscale adjustment image.

According to an embodiment, the display apparatus 100 may obtain a calibration effect based on Equation 9 presented below.

$$E=\alpha_{sin}\omega_{sin}+\alpha_{DR}\omega_{DR}+\alpha_{A}\omega_{B}+L \quad \text{Equation 9:}$$

where E is a calibration effect of an adjustment image, $\omega_{sin}$ is a difference of perceived visual sensation, $\omega_{DR}$ is a change in a dynamic range, $\omega_B$ is a change in a characteristic of an output image in comparison to an input image, and $\alpha_{sin}$, $\alpha_{DR}$ and $\alpha_A$ are weights, that is, constant values. Herein, $\omega_B$ is a change in a characteristic of an output image in comparison to an output image, and the display apparatus 100 may obtain a calibration effect by calibrating all changing characteristics of the output image in comparison to the input image by $\omega_B$ to maintain power consumption within a predetermined range.

According to an embodiment, the display apparatus 100 may obtain the plurality of calibration effects E based on at least one of Equations 1 to 9. Specifically, the display apparatus 100 may obtain a plurality of adjustment images by applying a plurality of grayscale adjustment curves.

The display apparatus 100 may calculate a change in the dynamic range and a difference in perceived visual sensation regarding each of the plurality of adjustment images. That is, the display apparatus 100 may predict output luminance and a difference in perceived visual sensation prior to really outputting the plurality of adjustment images. In addition, the display apparatus 100 may obtain a plurality of calibration effects regarding the plurality of adjustment images based on the predicted output luminance and the difference in perceived visual sensation.

In addition, the display apparatus 100 may obtain a grayscale adjustment curve corresponding to a maximum calibration effect among the plurality of calibration effects, and may adjust the grayscale of each pixel of the input image based on the obtained grayscale adjustment curve, and may output the image. In this case, the brightness of the adjustment image may be relatively darker than the input image, but the dynamic range may be further expanded than in the case where the input image is outputted as it is without adjusting brightness, and the difference in perceived visual sensation may not fall out of a predetermined level.

Figure 7A:
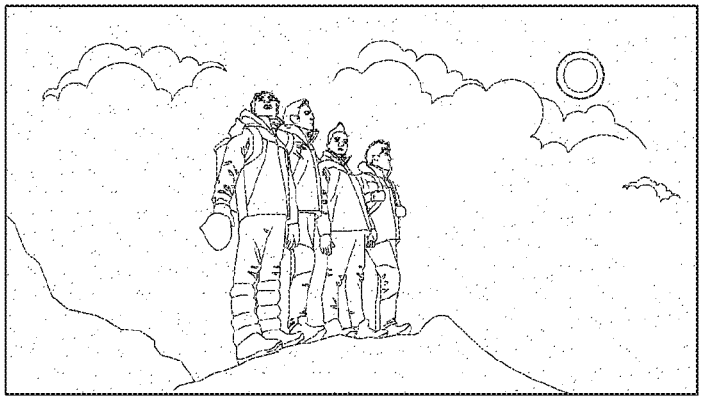
FIGS. 7A, 7B and 7C illustrate a comparison of output luminance of an input and a grayscale adjustment image according to an embodiment.
Figure 7B:
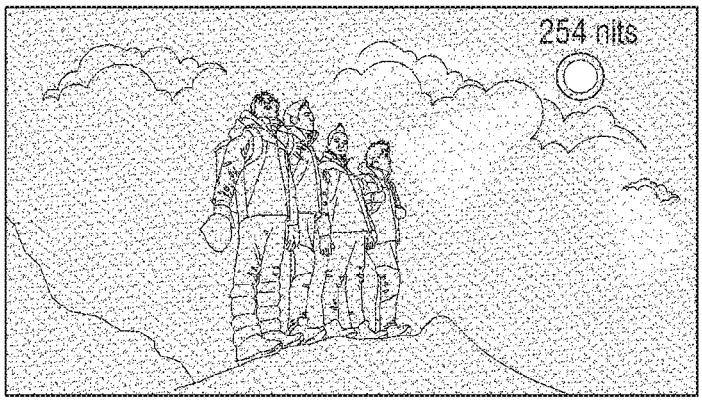
Figure 7C:
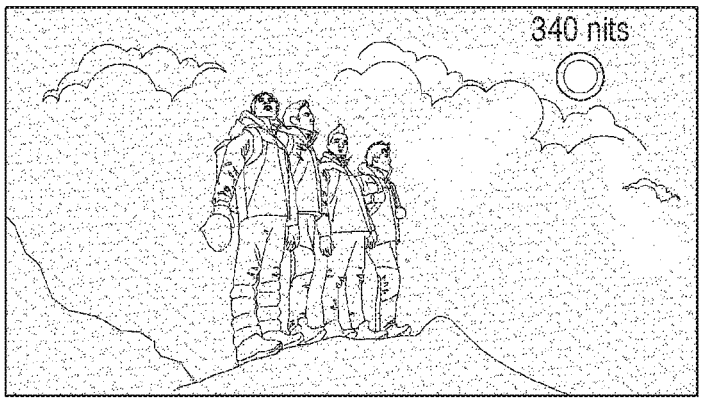

FIGS. 7A, 7B and 7C illustrate a comparison of output luminance of an input image and a grayscale adjustment image according to an embodiment.

Referring to FIG. 7A, when the display apparatus 100 outputs an input image in FIG. 7A, and adjusts output luminance to constantly maintain power consumption, the dynamic range may be narrowed. For example, the maximum output luminance of the input image in FIG. 7B has only 254 (Nits). To the contrary, according to various embodiments, when an image in which the grayscale of each pixel of the input image is adjusted according to a grayscale adjustment curve corresponding to the maximum calibration effect is outputted, power consumption may be maintained within a predetermined range, and simultaneously, the dynamic range may be maintain by higher than a predetermined level. For example, the maximum output luminance of the input image may be increased to 340 (Nits) as shown in FIG. 7C.

According to an embodiment, the display apparatus 100 may obtain calibration effects according to the plurality of grayscale adjustment images corresponding to the plurality of grayscale adjustment curves, and may adjust the grayscale value of the input image based on the grayscale adjustment curve corresponding to the maximum calibration effect among the plurality of calibration effects. Accordingly, the display apparatus 100 may output the input image, while constantly maintaining power consumption by reducing the brightness of the output image, and simultaneously, maintaining the dynamic range and the difference in perceived visual sensation on the grayscale adjustment image in comparison to the input original image at a predetermined level or higher.

Figure 8:
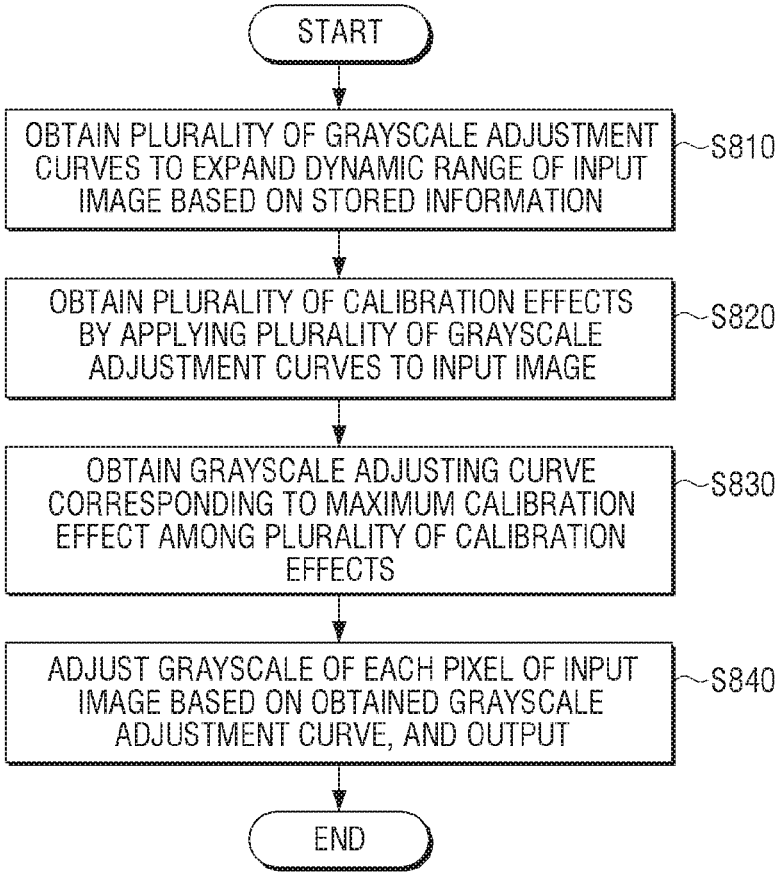
FIG. 8 is a flowchart to illustrate a control method of a display apparatus according to an embodiment.

FIG. 8 is a flowchart to illustrate a control method of a display apparatus according to an embodiment.

Referring to FIG. 8, the display apparatus, which stores output luminance information of each grayscale according to brightness information of an image according to an embodiment, obtains a plurality of grayscale adjusting curves for expanding a dynamic range of the input image, based on stored information (S810).

Next, the display apparatus obtains a plurality of calibration effects by applying the plurality of grayscale adjustment curves to the input image (S820).

Next, the display apparatus obtains a grayscale adjustment curve corresponding to a maximum calibration effect among the plurality of calibration effects (S830).

Next, the display apparatus adjusts the grayscale of each pixel of the input image based on the obtained grayscale adjustment curve, and outputs the image (S840).

Herein, the plurality of calibration effects may be calculated based on a change in the dynamic range and a difference in perceived visual sensation, caused by applying the plurality of grayscale adjustment curves to the input image.

The step S820 of obtaining the plurality of calibration effects may further include: obtaining a first adjustment image and a second adjustment image by applying a first grayscale adjustment curve and a second grayscale adjustment curve among the plurality of grayscale adjustment curves to the input image; obtaining first and second dynamic ranges according to output luminance predicted according to brightness information of each of the first and second adjustment images; and obtaining changes in the first and second dynamic ranges in comparison to the input image, by comparing the first and second dynamic ranges and the dynamic range of the input image.

The step S820 of obtaining the plurality of calibration effects may further include: calculating a difference in a first visual sensation based on a difference value between a graph maintaining the grayscale of each pixel included in the input image and the first grayscale adjustment curve, and calculating a difference in a second visual sensation based on a difference value between the graph and the second grayscale adjustment curve; and obtaining a first calibration effect based on the difference in the first visual sensation and the change in the first dynamic range, and obtaining a second calibration effect based on the difference in the second visual sensation and the change in the second dynamic range, and the step S830 of obtaining the grayscale adjustment curve corresponding to the maximum calibration effect may further include identifying one of the first calibration effect and the second calibration effect as the maximum calibration effect.

In addition, the step S820 of obtaining the plurality of calibration effects may include obtaining the first and second calibration effects by applying a first weight to the change in the first dynamic range and the change in the second dynamic range, and applying a second weight to the difference in the first visual sensation and the difference in the second visual sensation.

In addition, the output luminance information of each grayscale according to the brightness information of the image may be maximum output luminance information of each pixel according to the brightness information of the input image, calculated based on power consumption of the display apparatus.

In addition, the plurality of grayscale adjustment curves may include a first tone mapping curve and a second tone mapping curve for mapping the grayscale of each pixel included in the input image onto different adjustment grayscales.

Herein, the first and second tone mapping curves may be graphs expressed by Equation 10, as shown below, and may have different ω values:

$$t_i = 255 \times \left(\frac{i}{255}\right)^{(1+\omega)} \qquad \text{Equation 10}$$

In Equation 10, i is a grayscale of each pixel included in an input image, ω is an adjustment value, and $t_i$ is a grayscale of an adjustment image.

The brightness information of the image may be an average picture level (APL) of grayscale values of each pixel of the image.

The step S840 of outputting may include adjusting the grayscale of each pixel of the input image based on the obtained grayscale adjustment curve, and then outputting the input image according to output luminance corresponding to a grayscale adjusted based on the stored information.

Various embodiments described above may be implemented by executing instructions stored in a recording medium that can be read by a computer or a similar device using software, hardware, or a combination thereof. In some cases, embodiments described in the present disclosure may be implemented by a processor, such as a hardware processor. According to software implementation, embodiments such as procedures and functions described in the detailed description may be implemented as separate software modules. Each of the software modules may perform one or more functions and operations described in the detailed description.

Computer instructions for performing the processing operations according to various embodiments described above may be stored in a non-transitory computer-readable medium. The computer instructions stored in the non-transitory computer-readable medium may instruct a specific apparatus to perform the processing operations according to various embodiments described above when being executed by a processor.

The non-transitory computer-readable medium refers to a medium that stores data semi-permanently rather than storing data for a very short time, such as a register, a cache, and a memory, and is readable by an apparatus. Specifically, the non-transitory computer-readable medium may be a compact disc (CD), a digital versatile disk (DVD), a hard disk, a Blu-ray disk, a universal serial bus (USB), a memory card, and a read only memory (ROM).

While embodiments have been shown and described, it will be understood by those skilled in the art that various changes in form and details may be made therein without departing from the spirit and scope of the present disclosure as defined by the appended claims. Therefore, the scope of the present disclosure is defined not by the detailed description, but by the appended claims, and all differences within the scope will be construed as being included.

What is claimed is:

1. A display apparatus comprising:

a display;

a storage configured to store output luminance information of a plurality of grayscale values according to brightness information; and a processor configured to:

obtain a plurality of grayscale adjustment curves based on the output luminance information stored in the storage, obtain a plurality of calibration effects by applying each of the plurality of grayscale adjustment curves to an input image, obtain a grayscale adjustment curve corresponding to a maximum calibration effect from among the plurality of calibration effects, adjust a grayscale of each pixel of the input image based on the obtained grayscale adjustment curve to generate an output image, and output the output image through the display, wherein the plurality of calibration effects are based on a change in a dynamic range and a difference in perceived visual sensation.

2. The display apparatus of claim 1, wherein the processor is further configured to:

obtain a first adjustment image by applying a first grayscale adjustment curve from among the plurality of grayscale adjustment curves to the input image, obtain a second adjustment image by applying a second grayscale adjustment curve from among the plurality of grayscale adjustment curves to the input image, obtain a first dynamic range according to a first predicted output luminance corresponding to brightness information of the first adjustment image, obtain a second dynamic range according to a second predicted output luminance corresponding to brightness information of the second adjustment image, obtain a first dynamic range change by comparing the first dynamic range and an input dynamic range of the input image, and obtain a second dynamic range change by comparing the second dynamic range ranges and the input dynamic range of the input image.

3. The display apparatus of claim 2, wherein the processor is further configured to:

calculate a first visual sensation difference based on the input image and the first grayscale adjustment curve, calculate a second visual sensation difference based on the input image and the second grayscale adjustment curve, obtain a first calibration effect based on the first visual sensation difference and the first dynamic range change, obtain a second calibration effect based on the second visual sensation difference and the second dynamic range change, and identify one from among the first calibration effect and the second calibration effect as the maximum calibration effect.

4. The display apparatus of claim 3, wherein the processor is further configured to:

obtain the first calibration effect by applying a first weight to the first dynamic range change and a second weight to the first visual sensation difference, and obtain the second calibration effect by applying the first weight to the second dynamic range change and the second weight to the second visual sensation difference.

5. The display apparatus of claim 1, wherein the output luminance information of the plurality of grayscale values according to the brightness information of the input image indicates maximum output luminance information of each pixel according to the brightness information of the input image, and is calculated based on power consumption of the display apparatus.

6. The display apparatus of claim 1, wherein the plurality of grayscale adjustment curves comprises a first tone mapping curve and a second tone mapping curve.

7. The display apparatus of claim 6, wherein the first tone mapping curve and the second tone mapping curve are expressed by a following equation, and have different ω values:

$$t_i = 255 \times \left(\frac{i}{255}\right)^{(1+\omega)}$$

where i indicates a grayscale of a pixel included in the input image, ω is an adjustment value, and $t_i$ is a grayscale of an adjustment image.

8. The display apparatus of claim 1, wherein the brightness information indicates an average picture level (APL) of grayscale values of each pixel of the input image.

9. The display apparatus of claim 1, wherein the processor is further configured to output the output image through the display according to the adjusted grayscale of each pixel.

10. A control method of controlling a display apparatus, the control method comprising:

obtaining a plurality of grayscale adjustment curves based on output luminance information stored in a storage of the display apparatus;

obtaining a plurality of calibration effects by applying each of the plurality of grayscale adjustment curves to an input image;

obtaining a grayscale adjustment curve corresponding to a maximum calibration effect from among the plurality of calibration effects;

adjusting a grayscale of each pixel of the input image based on the obtained grayscale adjustment curve to generate an output image; and outputting the output image, wherein the plurality of calibration effects are based on a change in a dynamic range and a difference in perceived visual sensation.

11. The control method of claim 10, wherein the obtaining the plurality of calibration effects further comprises:

obtaining a first adjustment image by applying a first grayscale adjustment curve from among the plurality of grayscale adjustment curves to the input image;

obtaining a second adjustment image by applying a second grayscale adjustment curve from among the plurality of grayscale adjustment curves to the input image;

obtaining a first dynamic range according to a first predicted output luminance corresponding to brightness information of the first adjustment image;

obtaining a second dynamic range according to a second predicted output luminance corresponding to brightness information of the second adjustment image;

obtaining a first dynamic range change by comparing the first dynamic range and an input dynamic range of the input image; and obtaining a second dynamic range change by comparing the second dynamic range and the input dynamic range of the input image.

12. The control method of claim 11, wherein the obtaining the plurality of calibration effects further comprises:

calculating a first visual sensation difference based on the input image and the first grayscale adjustment curve;

calculating a second visual sensation difference based on the input image and the second grayscale adjustment curve; and obtaining a first calibration effect based on the first visual sensation difference and the first dynamic range change; and obtaining a second calibration effect based on the second visual sensation difference and the second dynamic range change, and wherein the obtaining the grayscale adjustment curve corresponding to the maximum calibration effect further comprises identifying one from among the first calibration effect and the second calibration effect as the maximum calibration effect.

13. The control method of claim 12, wherein the obtaining the plurality of calibration effects comprises:

obtaining the first calibration effect by applying a first weight to the first dynamic range change and a second weight to the first visual sensation difference; and obtaining the second calibration effect by applying the first weight to the second dynamic range change and the second weight to the second visual sensation difference.

14. The control method of claim 10, wherein the output luminance information indicates maximum output luminance information of each pixel according to the brightness information of the input image, and is calculated based on power consumption of the display apparatus.

15. The control method of claim 10, wherein the plurality of grayscale adjustment curves comprises a first tone mapping curve and a second tone mapping curve.

16. The control method of claim 15, wherein the first tone mapping curve and the second tone mapping curve are expressed by a following equation, and have different ω values:

$$t_i = 255 \times \left(\frac{i}{255}\right)^{(1+\omega)}$$

where i indicates a grayscale of a pixel included in the input image, ω is an adjustment value, and $t_i$ is a grayscale of an adjustment image.

17. The control method of claim 10, wherein the brightness information indicates an average picture level (APL) of grayscale values of each pixel of the input image.

18. The control method of claim 10, wherein the outputting comprises outputting the output image according to the adjusted grayscale of each pixel.

19. A non-transitory computer-readable medium which stores computer instructions to control a display apparatus to perform an operation when executed by a processor of the display apparatus, the operation comprising:

obtaining a plurality of grayscale adjustment curves based on output luminance information;

obtaining a plurality of calibration effects by applying the plurality of grayscale adjustment curves to an input image;

obtaining a grayscale adjustment curve corresponding to a maximum calibration effect from among the plurality of calibration effects;

adjusting a grayscale of each pixel of the input image based on the obtained grayscale adjustment curve to generate an output image; and controlling a display of the display apparatus to output the output image, wherein the plurality of calibration effects are based on a change in a dynamic range and a difference in perceived visual sensation.

* * * * *